US010609999B2

(12) United States Patent
Beck et al.

(10) Patent No.: US 10,609,999 B2
(45) Date of Patent: Apr. 7, 2020

(54) HAIR ELASTIC ACCESSORY

(71) Applicant: Pretty Empowered LLC, Framingham, MA (US)

(72) Inventors: Amy S. Beck, Framingham, MA (US); Neal Lackritz, Mountain View, CA (US)

(73) Assignee: Pretty Empowered LLC, Framingham, MA (US)

( * ) Notice: Subject to any disclaimer, the term of this patent is extended or adjusted under 35 U.S.C. 154(b) by 263 days.

(21) Appl. No.: 15/784,236

(22) Filed: Oct. 16, 2017

(65) Prior Publication Data

US 2019/0110570 A1 Apr. 18, 2019

(51) Int. Cl.

| | |
|---|---|
| ***A45D 8/12*** | (2006.01) |
| ***A45D 8/34*** | (2006.01) |
| *A45D 8/00* | (2006.01) |

(52) U.S. Cl.

CPC ..... *A45D 8/34* (2013.01); *A45D 2008/006* (2013.01)

(58) Field of Classification Search

CPC ... A45D 8/34; A45D 8/14; A45D 8/36; A45D 2008/006; A45D 2008/004; A45D 2008/008; A45D 2008/002; A45D 2008/345

USPC ..... 132/275

See application file for complete search history.

(56) References Cited

U.S. PATENT DOCUMENTS

| | | | | |
|---|---|---|---|---|
| 8,485,202 | B1 * | 7/2013 | Lujan-Puckett | A45D 8/00 132/275 |
| 9,022,043 | B1 * | 5/2015 | Lujan-Puckett | A45D 8/00 132/275 |
| 9,949,551 | B1 * | 4/2018 | Boles | A45D 8/20 |
| 2004/0154632 | A1 * | 8/2004 | Silva | A45D 8/34 132/273 |
| 2011/0239703 | A1 * | 10/2011 | MacMaster | A44C 15/001 63/15 |
| 2013/0042391 | A1 * | 2/2013 | Hill | A45C 13/08 2/244 |
| 2013/0091620 | A1 * | 4/2013 | Randolph | A41D 27/08 2/244 |
| 2013/0108884 | A1 * | 5/2013 | Lillich | A44C 25/00 428/542.2 |
| 2013/0291886 | A1 * | 11/2013 | Davis | A45D 8/36 132/275 |
| 2014/0209116 | A1 * | 7/2014 | Seibt | B44C 3/12 132/275 |
| 2015/0114419 | A1 * | 4/2015 | Miller | A45D 8/34 132/200 |
| 2016/0157578 | A1 * | 6/2016 | Ricci | A45D 8/34 132/200 |
| 2017/0224079 | A1 * | 8/2017 | Egner | A45D 8/14 |
| 2018/0070664 | A1 * | 3/2018 | Hazan | A41G 5/0073 |

* cited by examiner

*Primary Examiner* — Nicholas D Lucchesi
(74) *Attorney, Agent, or Firm* — Brian M. Dingman; Dingman IP Law, PC

(57) ABSTRACT

A hair elastic accessory with a first member comprising magnetic material and a structure that is constructed and arranged to releasably grip a hair elastic. There is a second member comprising magnetic material. The first and second members are adapted to be releasably magnetically coupled together.

18 Claims, 9 Drawing Sheets

Fig. 6A
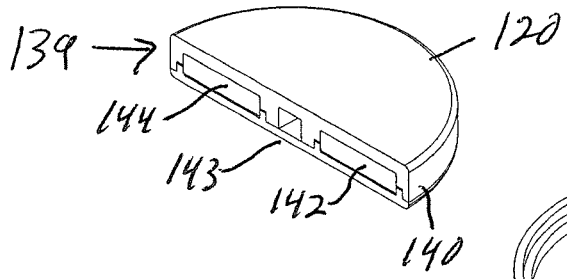
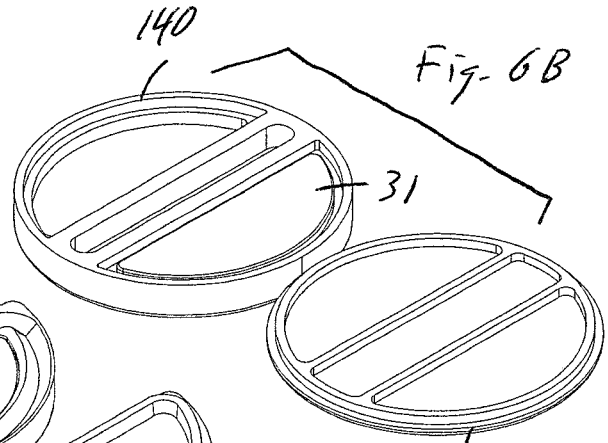
Fig. 6B
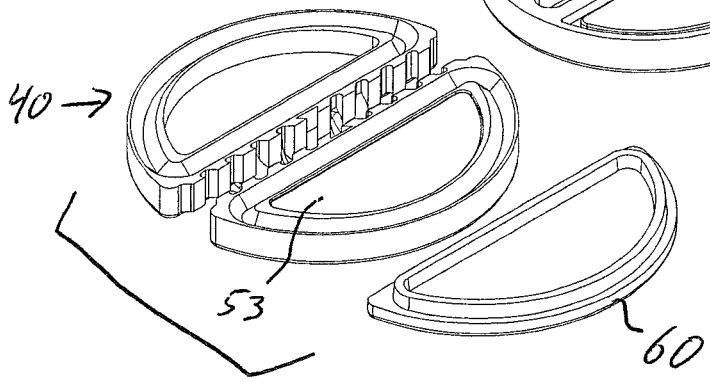
Fig. 3B

HAIR ELASTIC ACCESSORY

BACKGROUND

This disclosure relates to an accessory for hair elastics.

Hair elastics are sometimes decorated with a decorative piece that is clamped onto or otherwise fixed to the elastic. Once the elastic stretches or breaks, the decorative piece can no longer be used.

SUMMARY

All examples and features mentioned below can be combined in any technically possible way.

In one aspect, a hair elastic accessory includes a first member comprising magnetic material and a structure that is constructed and arranged to releasably grip a hair elastic, and a second member comprising magnetic material. The first and second members are adapted to be releasably magnetically coupled together. Generally, but not necessarily, the first and second members have the same shape (e.g., round, rectangular, square, or irregular shape).

Embodiments may include one of the following features, or any combination thereof. The magnets ideally fill as much of the facing surfaces of the two members as possible, given the shapes of the members and the mechanical design constraints of the members, such as the need to maintain structural integrity. For example, if the members are round (e.g., generally cylindrical) then the one or more magnets in each member preferably taken together as a whole (i.e., assembled together) present a generally round profile and fill as much as possible of the face of the member that will contact the face of the other member.

Embodiments may include one of the following features, or any combination thereof. The first member magnetic material may include two magnets. The first member may have a first surface, and the two magnets may be mounted such that a north pole of a first magnet faces the first surface and a south pole of a second magnet faces the first surface. The first and second magnets may each be generally semi-circular, or may be other shapes. Ideally, but not necessarily, the magnet(s) in each of the members generally match the shape of the member in which they are located, so as to maximize the strength of the magnetic field given the particular geometry of the member. The first member structure that is constructed and arranged to releasably grip a hair elastic may include a slot. The slot may include a plurality of gripping members.

Embodiments may include one of the following features, or any combination thereof. In one non-limiting example, the first member may be generally disk-shaped, and the slot may lie generally along a diameter of the first member. In this case, the first member magnetic material may comprise two magnets that are both generally flat and generally semi-circular shaped, with a first magnet located adjacent to a first side of the slot and a second magnet located adjacent to a second side of the slot.

Embodiments may include one of the following features, or any combination thereof. The second member magnetic material may comprise two magnets. The second member may have a first surface, and the two magnets may be mounted such that a north pole of a first magnet faces the first surface and a south pole of a second magnet faces the first surface. The first and second, second member magnets may each be generally semi-circular. The second member may be generally dome-shaped to present a domed decorative surface. The second member can be designed to be facing outwardly from the head when the accessory is worn in the hair. In this case the outer shape of the second member can be designed to present any type of decorative surface; a dome shape is only one of virtually unlimited possible shapes. The second member may define a cavity that is sized and shaped to receive the first member. The cavity may be sized and shaped such that the first member can nest fully within the second member.

In another, more specific, aspect, a hair elastic accessory includes a first member comprising two magnets and a structure that is constructed and arranged to releasably grip a hair elastic, wherein the first member has a first surface, and wherein the two first member magnets are mounted such that a north pole of a first, first member magnet faces the first surface and a south pole of a second, first member magnet faces the first surface. There is a second member comprising two magnets, wherein the second member has a first surface, and wherein the two second member magnets are mounted such that a north pole of a first, second member magnet faces the first surface and a south pole of a second, second member magnet faces the first surface. The first and second members are adapted to be releasably magnetically coupled together in a particular orientation, as established by the magnets and their relative orientations.

Embodiments may include one of the above and/or below features, or any combination thereof. The first member structure that is constructed and arranged to releasably grip a hair elastic may comprise a slot with a plurality of gripping members. The first and second first member magnets may be each generally semi-circular. The first member may be generally disk-shaped, wherein the slot lies generally along a diameter of the first member, wherein the first member magnets are both generally flat and generally semi-circular shaped, and wherein a first, first member magnet is located adjacent to a first side of the slot and a second, first member magnet is located adjacent to a second side of the slot. The first and second, second member magnets may each be generally flat and generally semi-circular.

In another, yet more specific, aspect, a hair elastic accessory includes a generally disk-shaped base member, the base member comprising two generally semi-circular magnets, and a slot with a plurality of gripping members that are constructed and arranged to releasably grip a hair elastic. The base member has an upper surface. The slot lies generally along a diameter of the base member. The base member magnets are both generally flat and generally semi-circular shaped, wherein a first base member magnet is located adjacent to a first side of the slot and a second base member magnet is located adjacent to a second side of the slot. The two base member magnets are mounted such that a north pole of a first base member magnet faces the upper surface and a south pole of a second base member magnet faces the upper surface. There is a top member comprising two generally semi-circular magnets, wherein the top member has a lower surface, and wherein the two top member magnets are mounted such that a north pole of a first top member magnet faces the lower surface and a south pole of a second top member magnet faces the lower surface. The top member is adapted to be releasably magnetically coupled to the base member in a particular orientation as established by the magnets. The top member defines a cavity that is sized and shaped such that the base member can nest fully within the top member when the base member and top member are magnetically coupled.

BRIEF DESCRIPTION OF THE DRAWINGS

FIG. 3B is a partially assembled view of the first member of the hair elastic accessory of FIGS. 1 and 2.

FIG. 6A is a cross-sectional view of the magnet carrier of the second member of FIGS. 1 and 2.

FIG. 6B is a partially assembled view of the magnet carrier of FIG. 6A.

DETAILED DESCRIPTION

Figure 1:
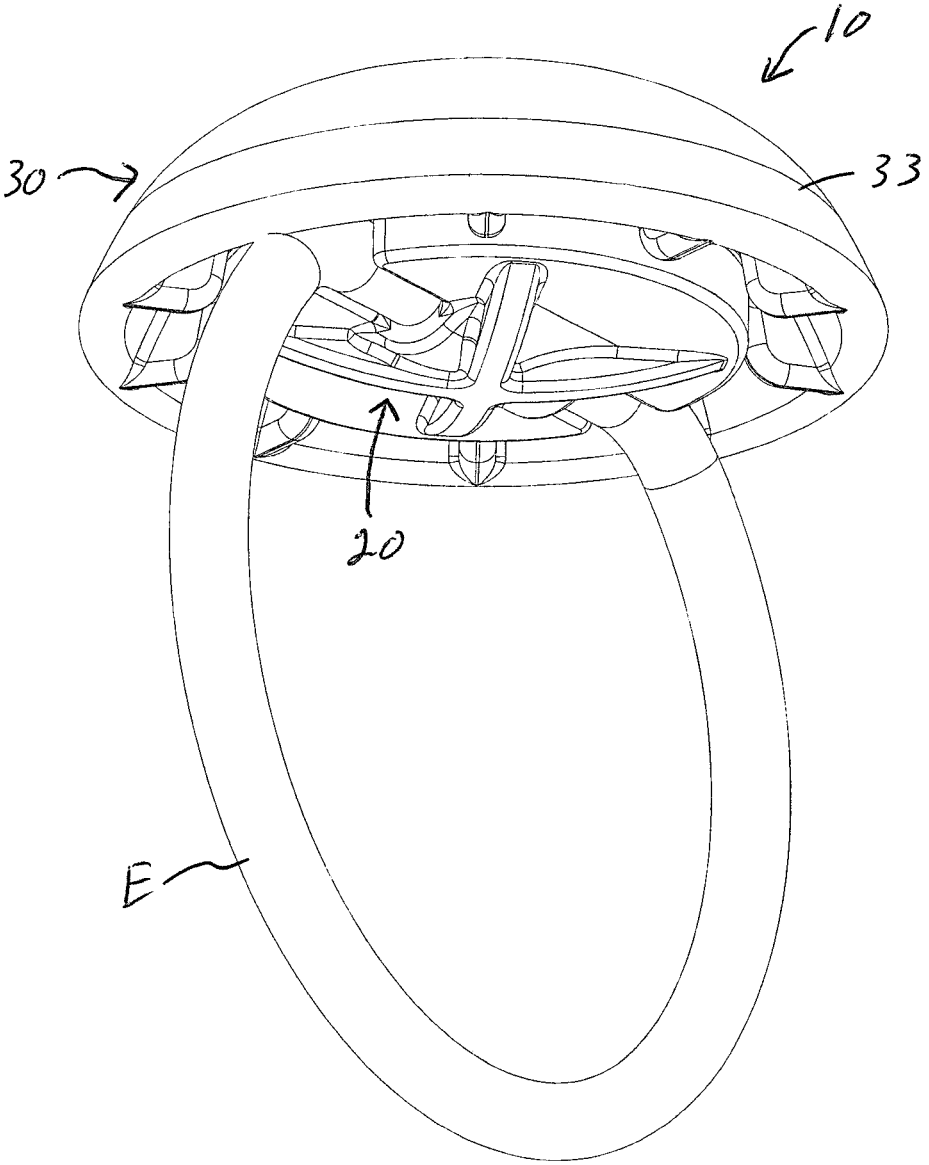
FIG. 1 is a bottom perspective view of a hair elastic accessory.
Figure 2:
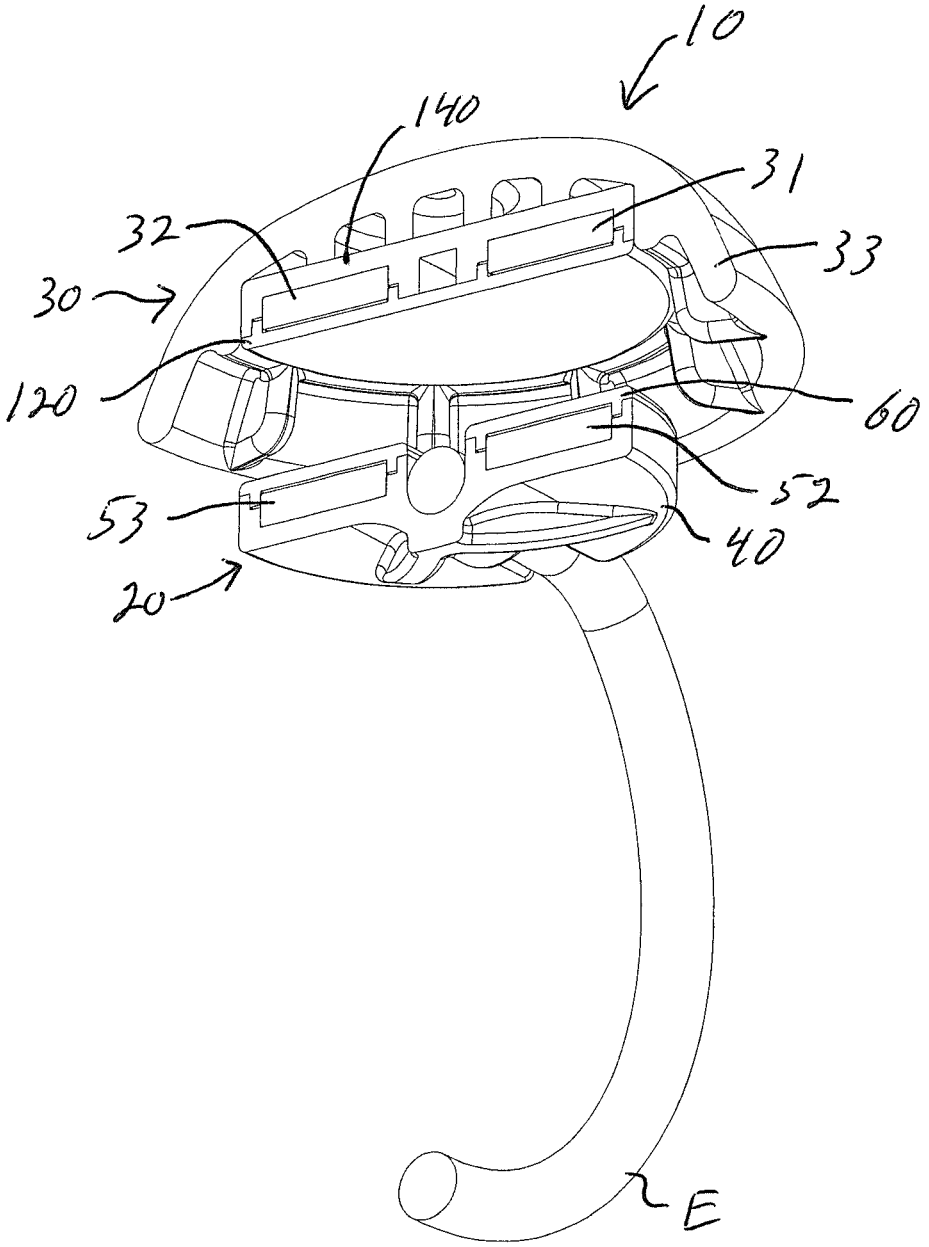
FIG. 2 is a disassembled, vertical cross-section of the hair elastic accessory of FIG. 1.
Figure 3A:
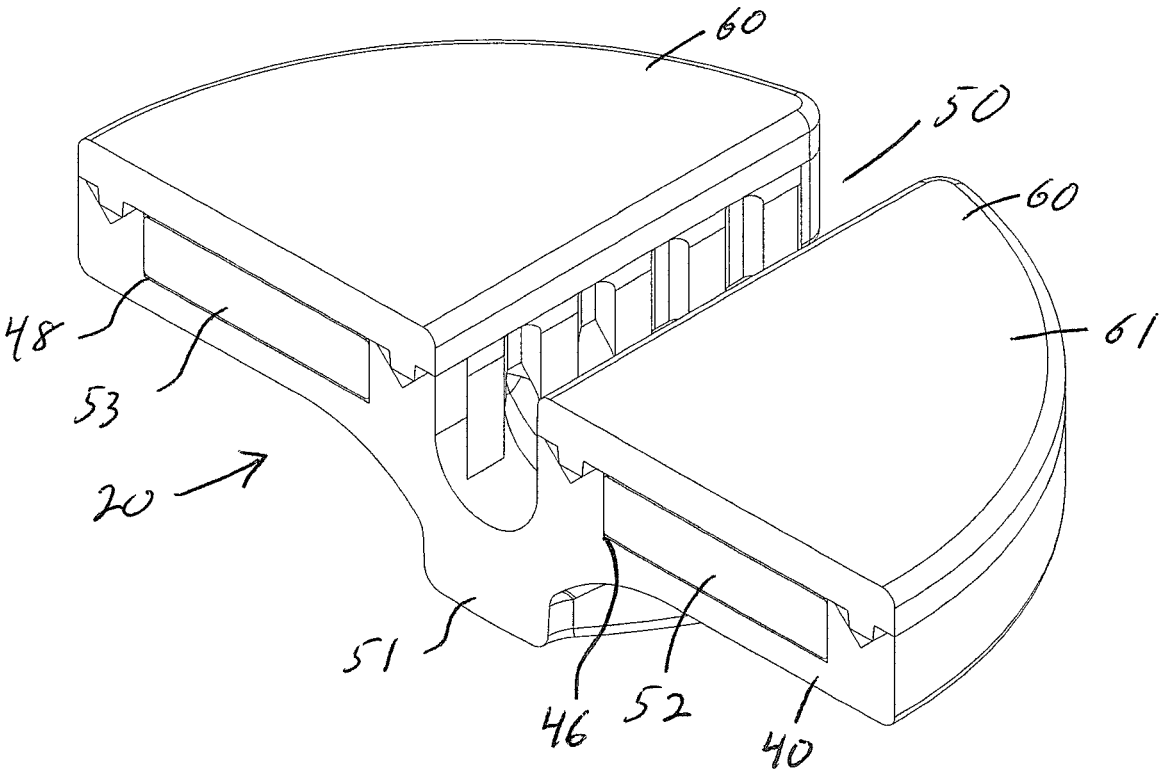
FIG. 3A is an enlarged view of the first member of the hair elastic accessory of FIGS. 1 and 2.
Figure 4C:
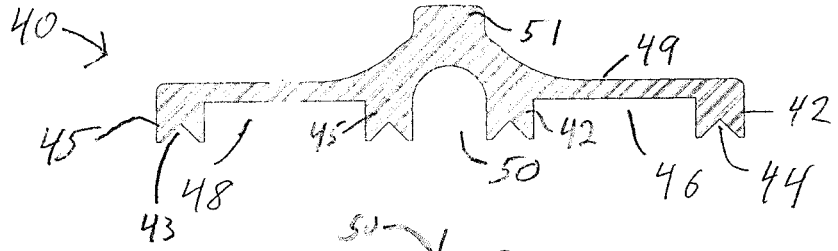
FIG. 4C is a cross-section taken along line 4C-4C of FIG. 4A.
Figure 4A:
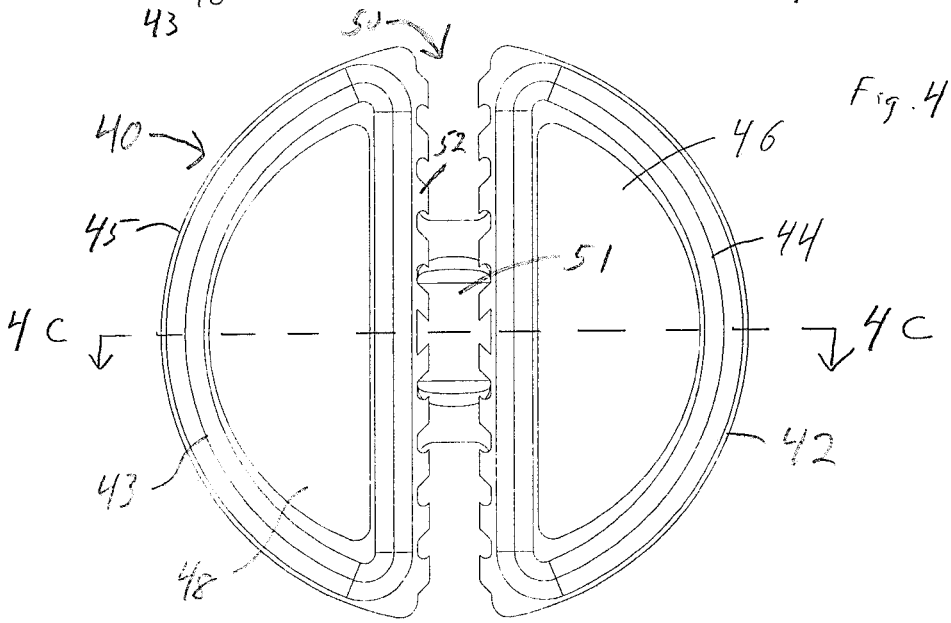
FIG. 4A is a top view and FIG. 4B is a perspective view of the disk structure of the first member of FIGS. 3A and 3B.
Figure 4B:
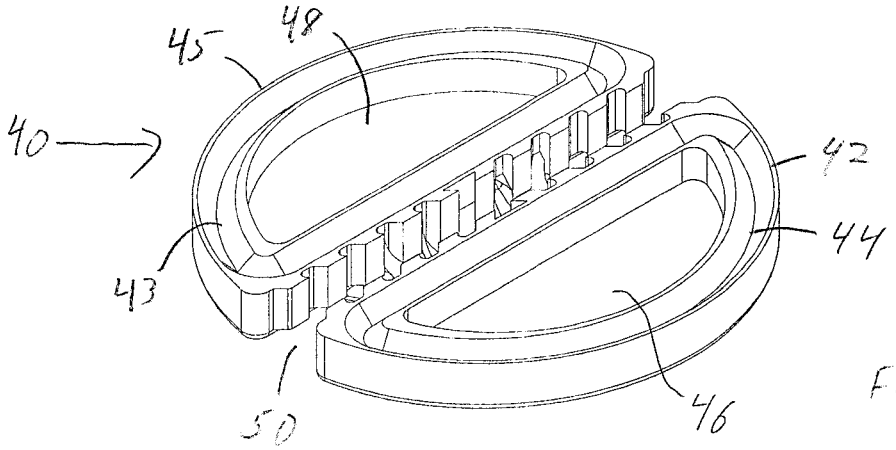
Figure 5C:
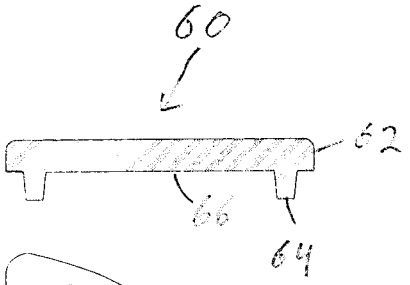
FIG. 5C is a cross-section taken along line 5C-5C of FIG. 5A.
Figure 5A:
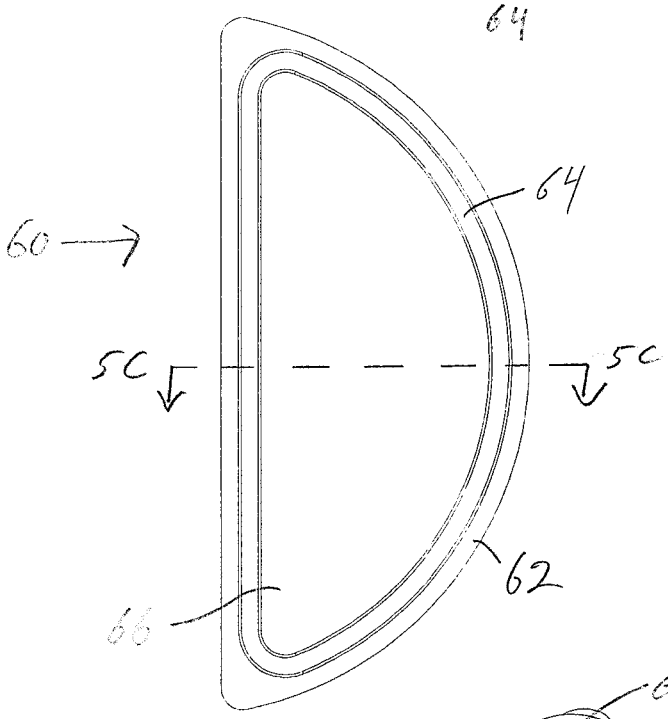
FIG. 5A is a top view and FIG. 5B is a perspective view of the backing members of the first member of FIGS. 3A and 3B.
Figure 5B:
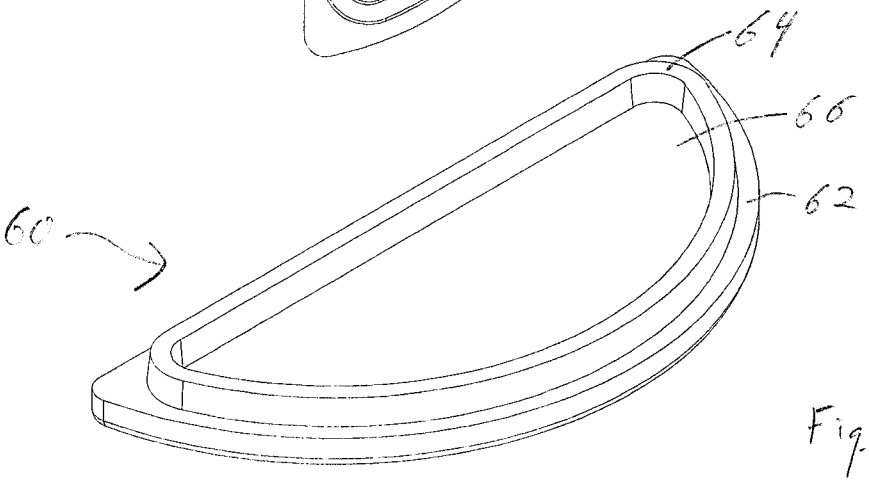

The hair elastic accessory comprises two members that are constructed and arranged to be magnetically, releasably, coupled together. A first member is constructed and arranged to releasably grip a hair elastic; this allows the first member to be attached to a hair elastic that a person has already placed in the hair, for example to hold a pony-tail in place. The second member is then magnetically coupled to the first member. Preferably, but not necessarily, the magnets/magnetic material of the first and second members are arranged to accomplish a particular/preferred rotational alignment between the two members. When the member that is on top (i.e., not facing the head and so visible to others) carries a decoration, the particular orientation between the two members can allow the decoration to assume a predetermined orientation. For example, if the decoration includes one or more words, the orientation can ensure that the words are properly oriented to another person behind the wearer, so that the word(s) can be read by the other person.

Two of many possible variations of the hair elastic accessory are shown in the drawings. These variations exemplify the invention but in no way limit the scope of the invention, as in part is further explained below.

A first variation is shown in FIGS. 1-6. Hair elastic accessory 10 comprises first member 20 that comprises magnetic material and a structure that is constructed and arranged to releasably grip a hair elastic "E." Second member 30 comprises magnetic material. The first and second members are adapted to be releasably, magnetically coupled together. First and second members in this non-limiting example are round when viewed from the top or bottom, but that is not necessary. The members can be any shape. The members are structurally designed to include one or more magnets or pieces made of magnetic material. The two examples described herein are thus exemplary only of the myriad designs that could achieve the stated objectives, and do not limit the scope of the present disclosure.

First member 20 in this example includes two magnets 52 and 53 that comprise the magnetic material. These magnets are preferably but not necessarily generally semi-circular shaped, as further explained below. The first member 20 may have a first surface 61, and the two magnets may be mounted such that a north pole of a first magnet faces the first surface and a south pole of the second magnet faces the first surface. The first and second magnets may each be generally semi-circular.

The first member structure that is constructed and arranged to releasably grip a hair elastic may include a slot 50. Slot 50 may include a plurality of gripping members 52 (only one of which is numbered in FIGS. 4A and 4B). The slot does not need gripping members, but the gripping members may accomplish a tighter grip on an elastic, to help keep the accessory in place as the user moves. The first member may be generally disk-shaped as shown, and the slot 50 may lie generally along a diameter of the first member. The first member magnetic material may comprise two magnets that are both generally flat and generally semi-circular shaped as shown, with a first magnet located adjacent to a first side of the slot and a second magnet located adjacent to an opposed second side of the slot.

In this particular, non-limiting example, first member 20 includes five separate pieces that are permanently joined to form a single member. Disk 40 may be an injection-molded part made from a suitable plastic material, selected to achieve desired physical characteristics. Disk 40 defines cavities 46 and 48 that are backed by portion 49. Each such cavity is sized and shaped to hold one of semi-circular thin planar magnets 52 and 53. Channel 44 surrounds cavity 46 and channel 43 surrounds cavity 48. These channels are formed in upstanding walls 42 and 45. Slot 50 extends along a diameter of the disk, and is wide and deep enough to grip most standard hair elastics, as is further explained below. Central disk portion 51 extends outward from surface 49, to accommodate slot 50. The disk could alternatively be made thicker such that surface 49 was flat, but this would add material and weight that is not necessary to accomplish the functionality of this first member. A backing member 60, FIGS. 5A-5C (which can be made of the same plastic material as disk 40), covers each of cavities 46 and 48 to complete first member 20. Tapered upstanding wall 64 that extends from flat surface 66 are sized and shape to fit into channels 43 and 44. Channels 43 and 44 are tapered as shown to ensure good contact between the parts so that they couple together more strongly. Rim 62 will sit on the tops of portions 42 and 45.

First member 20 can be assembled by placing magnets 52 and 53 in cavities 46 and 48, placing a backing member 60 over each magnet, and then fixing members 60 to disk 40, such as by ultrasonic welding or adhesive, for example. The result is a unitary structure that comprises two magnets, one with its north pole facing the upper side (as defined by a backing member 60) with the south pole of the other magnet facing the upper side. Although the shape and orientations of the magnets is not required, the flat faced rare-earth magnets that are preferably used present the largest possible magnet faces at the upper side of member 20, to accomplish a strong magnetic field at the upper side. The N-S orientation establishes only one particular orientation of the second member when it is coupled to the first member, as described below.

If a particular rotational orientation between the first and second members is not needed, then this N-S magnet orientation may not be needed.

Second member 30 in this example includes two main plastic parts that are also preferably permanently bonded together (plus two magnets, as described). The first part is magnet carrier 139, best shown in FIGS. 6A and 6B. The second part is decorative shell 33, best shown in FIGS. 1 and 2. In the alternative example shown in FIGS. 7 and 8, there is no separate magnet carrier; this alternative example is further described below.

Magnet carrier 139 is broadly similar to first member 20 in that it is constructed and arranged to present faces of two strong magnets proximate its lower surface 143, preferably with the N face of one magnet proximate surface 143 and the S face of the other magnet proximate surface 143. Disk structure 140 is a molded plastic part that defines magnet-receiving cavities 142 and 144 in which semi-circular magnets 31 and 32 are received (only magnet 31 is shown in FIG. 6B). These magnets can be the same size, shape, and material as magnets 52 and 53, but need not be. Backing member 120 (shown in detail in FIGS. 8A-8C) has upstanding portions 124, 130, and 132, that are sized and shaped to fit into channels in disk structure 140, to accomplish a tight fit between the two in order to encapsulate the magnets and provide mating surfaces that can be bonded together, such as via ultrasonic welding or adhesive. Outer rim 122 mates to the outer rim of disk structure 140. Cavities 126 and 128 help to accommodate magnets 31 and 32.

As with the first member, a primary function of the second member is to hold two magnets with their faces close to lower surface 143, so that the magnets lie close to the magnets of the first member when the two members are coupled together. If the magnets have properly arranged N-S orientations, when the first and second members are brought close together the opposed N-S faces of the first and second members naturally align, to accomplish one rotational orientation between the two. Note that the magnetic material in each member does not need to include two magnets. One or more magnets could be used. Also, magnetic material (such as ferromagnetic structures) could be used in place of one or more magnets, as long as there is sufficient magnetic force between the two members to accomplish a desired result. Further, one or both members could conceivably be made entirely of magnetic material. For example, member 20 could be made by machining or otherwise forming a magnet. If the elastic-retention feature is in member 30, member 20 could conceivably be a simple magnet, for example a disc-shaped magnet.

Figure 7C:
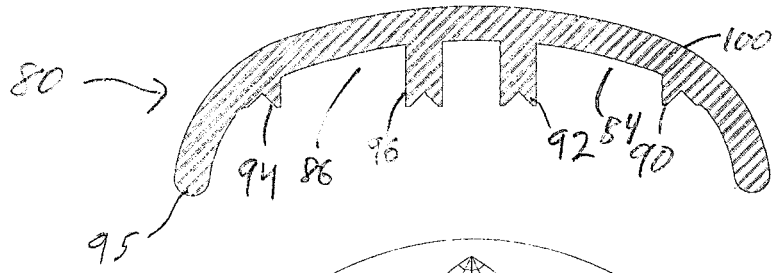
FIG. 7C is a cross-section taken along line 7C-7C of FIG. 7A.
Figure 7A:
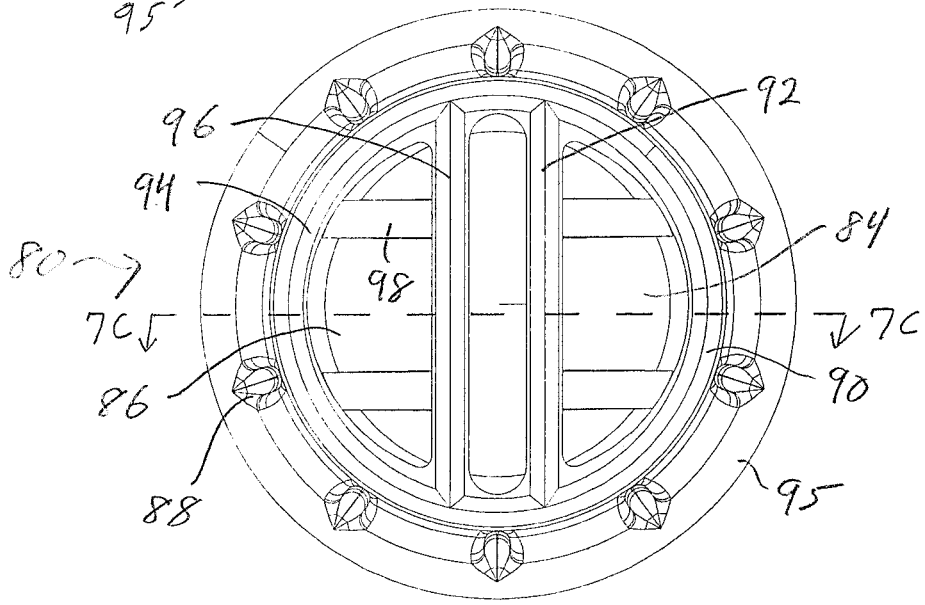
FIG. 7A is a top view and FIG. 7B is a perspective view of an alternative decorative shell for the second member of the hair elastic accessory.
Figure 7B:
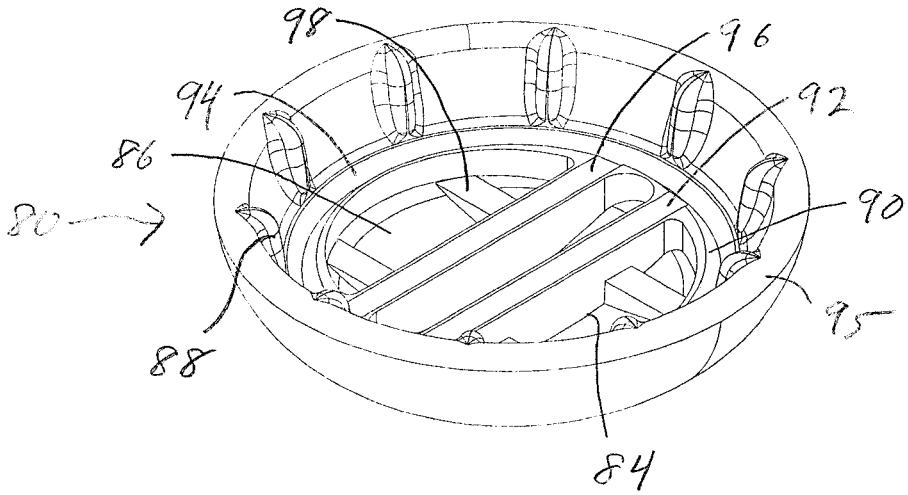
Figure 8C:
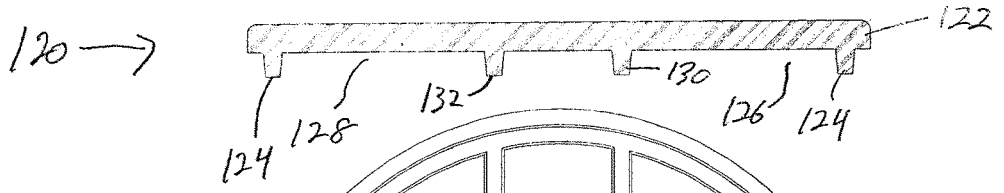
FIG. 8C is a cross-section taken along line 8C-8C of FIG. 8A.
Figure 8A:
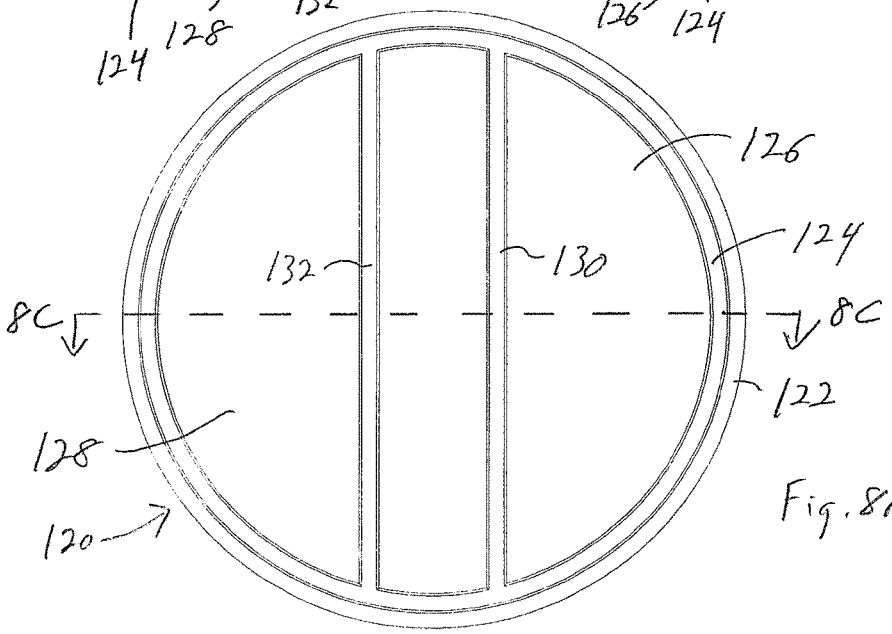
FIG. 8A is a top view and FIG. 8B is a perspective view of the backing member of the second member of the hair elastic accessory.
Figure 8B:
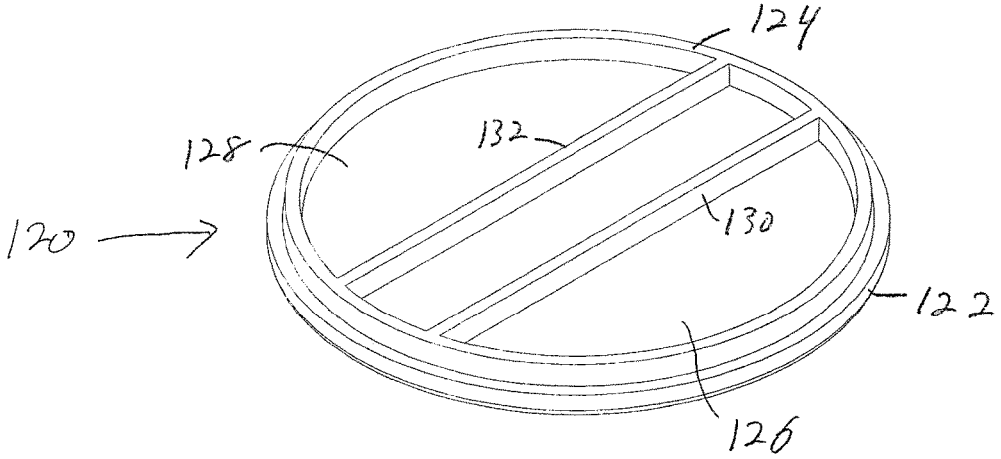
Figure 9:
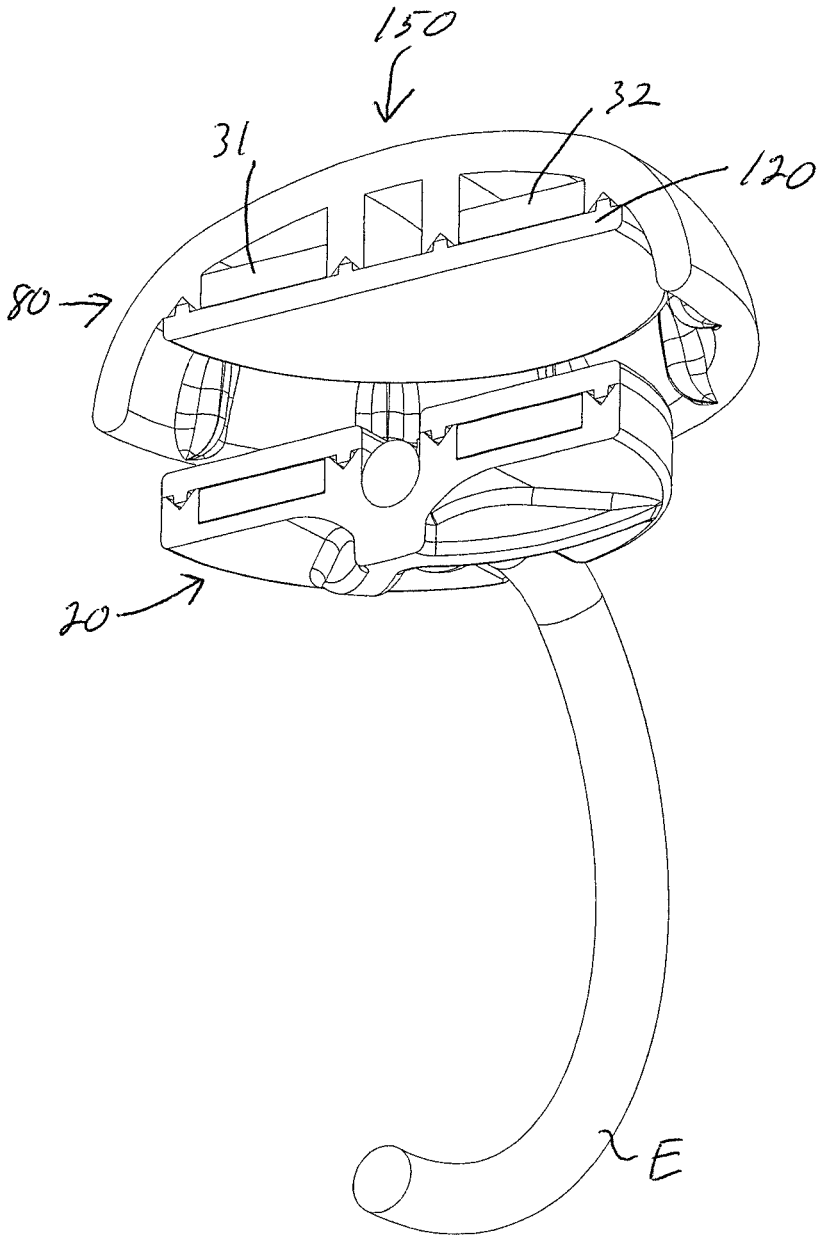
FIG. 9 is a view similar to that of FIG. 2, but for a second embodiment.

Note that either or both the first and second members could be accomplished in a variety of other manners, in order to accomplish magnetic coupling of the two. Such other manners would be apparent to a person skilled in the field and so are not fully described. As only one example, an alternative construction of the second member is shown in FIGS. 7A-7C and 8A-8C, and FIG. 9. In this case, the second member comprises plastic shell 80, magnets 31 and 32, and backing member 120. In other words, this version of the second member is accomplished without a separate disk structure 140. Instead, shell 80 is designed to directly hold the two magnets, which are then encapsulated by the backing member 120. An exploded view of hair elastic accessory 150 is shown in FIG. 9. Member 20 in this case is the same as in the first example.

Shell 80 comprises outer surface 100 that can be decorated or not, as desired. Also, the semi-spherical shape is not necessary, as the shell could be flat or take any other desired shape. It is desirable but not necessary that the shell have a cavity with enough depth to receive, and preferably, fully nest, the first member, as shown in FIG. 1 so that the first member does not extend below rim 95 and so is not visible from the side. Shell 80 has a number of spaced inwardly-protruding structures 88 that help to center the first member as the first member is coupled to the second member. This same result could be accomplished in other manners, such as by properly defining the internal wall shape and the thickness of the shell to define a cavity that receives the first member.

Shell 80 defines pockets 84 and 86 that are sized and shaped to receive a semi-circular magnet, such as those described above. Each pocket is surrounded by an upstanding wall that includes a receptacle for one of walls 124, 130, or 132, of backing member 120. These upstanding walls are best shown in FIG. 7C and include walls 90, 92, 94, and 96. Four lower structures such as structure 98 provide a flat surface on which the magnets sit. These structures are used rather than a continuous flat lower surface in order to use less plastic and thus save both cost and weight.

The hair elastic accessory of the present disclosure is generally used by coupling one member to a hair elastic, and then magnetically coupling the other member to the one member. Note that in the examples described above the first member has the structure that grips an elastic. However, this structure could be in the second (i.e., the top) member, and the first member could be located below the second member. Generally, the hair elastic accessory is used as follows. An elastic is placed in the hair in a normal manner, such as by wrapping it around a pony-tail one or more times. The member that grips the elastic (generally, the first member) is then coupled to the elastic. Generally, slot 50 has a width that is a bit less than that of a normal elastic. The elastic is then stretched to thin it, so it can fit in the slot. When the elastic is relaxed it widens and thus the member is tightly held on the elastic. The other member (generally, the second member) is then place on the first member and moved until the magnets attract and couple the two members together. The second member can easily be replaced, to allow any decoration carried by the second member to be replaced. The shape and outer surface of the second member are designed to achieve a desired decorative effect.

A number of implementations have been described. Nevertheless, it will be understood that additional modifications may be made without departing from the scope of the inventive concepts described herein, and, accordingly, other embodiments are within the scope of the following claims.

What is claimed is:

1. A hair elastic accessory, comprising:

a first member comprising magnetic material and a structure that is constructed and arranged to releasably grip a hair elastic;

a second member comprising magnetic material;

wherein the first and second members are adapted to be releasably magnetically coupled together;

wherein at least one of the first member magnetic material and the second member magnetic material comprises two magnets;

wherein the first member has a first surface and the second member has a first surface; and wherein the two magnets of at least one of the first member and the second member are mounted such that a north pole of a first magnet faces the first surface and a south pole of a second magnet faces the first surface.

2. The hair elastic accessory of claim 1, wherein the first member magnetic material comprises first and second magnets that are each generally semi-circular.

3. The hair elastic accessory of claim 1, wherein the first member structure that is constructed and arranged to releasably grip a hair elastic comprises a slot.

4. The hair elastic accessory of claim 3, wherein the slot comprises a plurality of gripping members.

5. The hair elastic accessory of claim 3, wherein the first member is generally disk-shaped, and wherein the slot lies generally along a diameter of the first member.

6. The hair elastic accessory of claim 5, wherein the first member magnetic material comprises two magnets that are both generally flat and generally semi-circular shaped, wherein a first magnet is located adjacent to a first side of the slot and a second magnet is located adjacent to a second side of the slot.

7. The hair elastic accessory of claim 1, wherein the magnetic material of each of the first and second members comprises two magnets.

8. The hair elastic accessory of claim 7, wherein the two magnets of each of the first and second members are mounted such that a north pole of a first magnet faces the first surface and a south pole of a second magnet faces the first surface.

9. The hair elastic accessory of claim 8, wherein the first and second magnets of each of the first and second members are each generally semi-circular.

10. The hair elastic accessory of claim 7, wherein the second member is generally dome-shaped.

11. The hair elastic accessory of claim 1, wherein the second member defines a cavity that is sized and shaped to receive the first member.

12. The hair elastic accessory of claim 11, wherein the cavity is sized and shaped such that the first member can nest fully within the second member.

13. A hair elastic accessory, comprising:

a first member comprising two magnets and a structure that is constructed and arranged to releasably grip a hair elastic, wherein the first member has a first surface, and wherein the two first member magnets are mounted such that a north pole of a first, first member magnet faces the first surface and a south pole of a second, first member magnet faces the first surface; and a second member comprising two magnets, wherein the second member has a first surface, and wherein the two second member magnets are mounted such that a north pole of a first, second member magnet faces the first surface and a south pole of a second, second member magnet faces the first surface;

wherein the first and second members are adapted to be releasably magnetically coupled together in a particular orientation, as established by the two first member magnets and the two second member magnets.

14. The hair elastic accessory of claim 13, wherein the first member structure that is constructed and arranged to releasably grip a hair elastic comprises a slot with a plurality of gripping members.

15. The hair elastic accessory of claim 14, wherein the first member is generally disk-shaped, wherein the slot lies generally along a diameter of the first member, wherein the first member magnets are both generally flat and generally semi-circular shaped, wherein a first, first member magnet is located adjacent to a first side of the slot and a second, first member magnet is located adjacent to a second side of the slot.

16. The hair elastic accessory of claim 13, wherein the first and second first member magnets are each generally semi-circular.

17. The hair elastic accessory of claim 13, wherein the first and second, second member magnets are each generally flat and generally semi-circular.

18. A hair elastic accessory, comprising:

a generally disk-shaped base member, the base member comprising two generally semi-circular magnets, and a slot with a plurality of gripping members that are constructed and arranged to releasably grip a hair elastic, wherein the base member has an upper surface, wherein the slot lies generally along a diameter of the base member, wherein the base member magnets are both generally flat, wherein a first base member magnet is located adjacent to a first side of the slot and a second base member magnet is located adjacent to a second side of the slot, and wherein the two base member magnets are mounted such that a north pole of the first base member magnet faces the upper surface and a south pole of the second base member magnet faces the upper surface; and a top member comprising two generally semi-circular magnets, wherein the top member has a lower surface, and wherein the two top member magnets are mounted such that a north pole of a first top member magnet faces the lower surface and a south pole of a second top member magnet faces the lower surface;

wherein the top member is adapted to be releasably magnetically coupled to the base member in a particular orientation as established by the two first member magnets and the two second member magnets; and wherein the top member defines a cavity that is sized and shaped such that the base member can nest fully within the top member when the base member and top member are magnetically coupled.

* * * * *